US005338261A

United States Patent [19]

Stegman

[11] Patent Number: 5,338,261

[45] Date of Patent: Aug. 16, 1994

[54] POOL CUE STAND AND CHALK HOLDER

[75] Inventor: David E. Stegman, Brookshire, Tex.

[73] Assignee: Replay Amusements, Inc., Houston, Tex.

[21] Appl. No.: 1,153

[22] Filed: Jan. 7, 1993

[51] Int. Cl.[5] ..... A63D 15/10

[52] U.S. Cl. ..... 473/1; 211/68

[58] Field of Search ..... 273/14, 22, 18, 19, 273/20; 248/231.8, 110; 211/68, 86, 60.1; 206/315.9, 315.1, 579; D6/552

[56] References Cited

U.S. PATENT DOCUMENTS

| | | | |
|---|---|---|---|
| 1,127,318 | 2/1915 | Thomas | 273/18 |
| 1,478,032 | 12/1923 | Hine | 211/68 |
| 1,503,120 | 7/1924 | Dorst | 211/68 |
| 1,683,533 | 9/1928 | Dorst | 211/68 |
| 3,209,918 | 10/1965 | Farrell | 211/68 |

FOREIGN PATENT DOCUMENTS

| | | | |
|---|---|---|---|
| 541199 | 7/1922 | France | 211/68 |
| 605591 | 5/1926 | France | 211/68 |
| 43290 | 4/1934 | France | 211/68 |

OTHER PUBLICATIONS

Peach State Distributing Company catalog–1989, pp. 337, 338, 340.

*Primary Examiner*—Theatrice Brown

*Attorney, Agent, or Firm*—Douglas W. Rommelmann; J. M. Gilbreth; Benjamin A. Adler

[57] ABSTRACT

A storage apparatus for use with pool cues and cone chalk. The storage apparatus includes a housing having upper and lower ends and a substantially vertical surface between the upper and lower ends. An upper member is attached to the upper end of the housing. The upper member has a plurality of openings extending therethrough. An intermediate member is attached to the housing below the upper member. The intermediate member has a plurality of openings extending therethrough corresponding to the plurality of openings in the upper member. The plurality of openings in the intermediate members are substantially vertically positioned below the plurality of openings in the upper member. A rod is attached to the upper member for locating the cone chalk. The openings in the upper and intermediate members are sized to receive a pool cue.

13 Claims, 2 Drawing Sheets

POOL CUE STAND AND CHALK HOLDER

FIELD OF THE INVENTION

The present invention relates to pool and billiard accessories, and more specifically to pool cue stands and chalk holders.

BACKGROUND OF THE INVENTION

Billiards and pool are popular games enjoyed in both private homes as well as in public places. The games of billiards and pool require a playing table, balls, and a cue. The cue is a leather-tipped tapering rod used to strike the cue ball. Cues come in a variety of lengths, weights and thicknesses to accommodate a player's preference. Thus, normally several cues are available to select from when playing a game of billiards or pool. The cues are typically stored at a convenient location near the playing table.

There are two basic types of storage devices for cues. The first is a wall-mounted rack having an upper member with a plurality of spring clips which receive the upper portion of the cue and a lower member having a plurality of recesses for receiving the lower end of the cues. The upper and lower members are permanently fastened to the wall and thus cannot be moved about. Although the wall-mounted racks are suitable to withstand the treatment encountered in one's home, it has been found that these racks do not satisfactorily withstand the treatment and abuse encountered in public or commercial establishments. Oftentimes, the spring clips fail and/or the fasteners securing the members to the wall pull out. Thus, maintaining wall-mounted cue racks is a continuous and costly endeavor in a commercial establishments.

The second type of cue storage apparatus is a floor standing cue rack. The floor standing cue rack typically comprises a base member which rests on the floor and includes one or more rods extending vertically above the base member. The rod or rods support an upper member having a plurality of holes through which the cues are inserted. The base member includes a plurality of recesses which receive the lower end of the cues. Alternatively, a lower member having a plurality of holes is positioned between the upper member and the base member and is supported by the vertical rod(s). In this alternate embodiment, the lower portion of the cue is inserted through the holes until the lower end of the cue comes to rest on the base member. The floor standing cue racks are moveable and generally of lightweight construction. In commercial applications, it has been found that the lightweight floor standing racks are not durable and often must be replaced.

An accessory item to the games of billiards and pool is chalk which the player applies to the hand and fingers to absorb moisture and provide a smooth, sliding surface for the cue when striking the cue ball. Typically, the chalk is conically shaped and has a central bore extending through the cone of chalk. The cone of chalk is usually lowered over a rod which is vertically mounted to a holder attached to a wall. The player slides his or her hand and fingers down the cone of chalk to apply chalk to the hand. During this application, a certain amount of chalk dust falls from the hand and cone to the floor below which results in a safety hazard due to the increased possibility of a person slipping and falling on the chalk-coated floor surface.

In addition to the safety aspects of the chalk-coated floor, the chalk also requires constant and routine cleaning of the floor not only in the area below the cone of chalk but throughout the room since the players walk in it and carry it around the table and the room.

It is desirable to have a sturdy, moveable, and durable cue rack which can withstand the abuse encountered in a commercial establishment such as a pool hall. It is further desirable to have a cue rack which requires no maintenance or replacement. It would also be desirable to incorporate advertising material on the cue racks such that companies could endorse products on the cue racks which would help in defraying the operating cost of the pool hall proprietor. It would also be desirable to eliminate the safety hazard and floor mess associated with the cone chalk.

SUMMARY OF THE INVENTION

The present invention is a floor standing pool cue stand for storing cues and cone chalk. The cue stand is moveable and extremely durable. The cue stand can be used to display advertising materials and also eliminates the usual mess on the floor from the cone chalk.

The cue stand includes a housing having upper and lower ends and a substantially vertical surface between the upper and lower ends. The vertical surface has a surface area suitable for receiving an advertisement easily discerned from an appropriate distance in a room containing pool or billiard tables.

An upper member is attached to the upper end of the housing. The upper member has a plurality of openings extending therethrough for receiving the lower end of the cues. An intermediate member is attached to the housing below the upper member. The intermediate member has a plurality of openings extending therethrough corresponding to the plurality of openings in the upper member. The plurality of openings in the intermediate members are substantially vertically positioned below the plurality of openings in the upper member. A guide sleeve is vertically inserted through each upper opening and the corresponding lower opening to guide the cues to a vertical position in the cue stand.

A cone chalk rod is vertically attached to a recessed area in the upper member for locating the cone chalk.

BRIEF DESCRIPTION OF THE DRAWINGS

The objects, advantages and features of the invention will become more apparent by reference to the drawings which are appended hereto and wherein like numerals indicate like parts and wherein an illustrated embodiment of the invention is shown, in which.

DETAILED DESCRIPTION OF INVENTION

Figure 2:
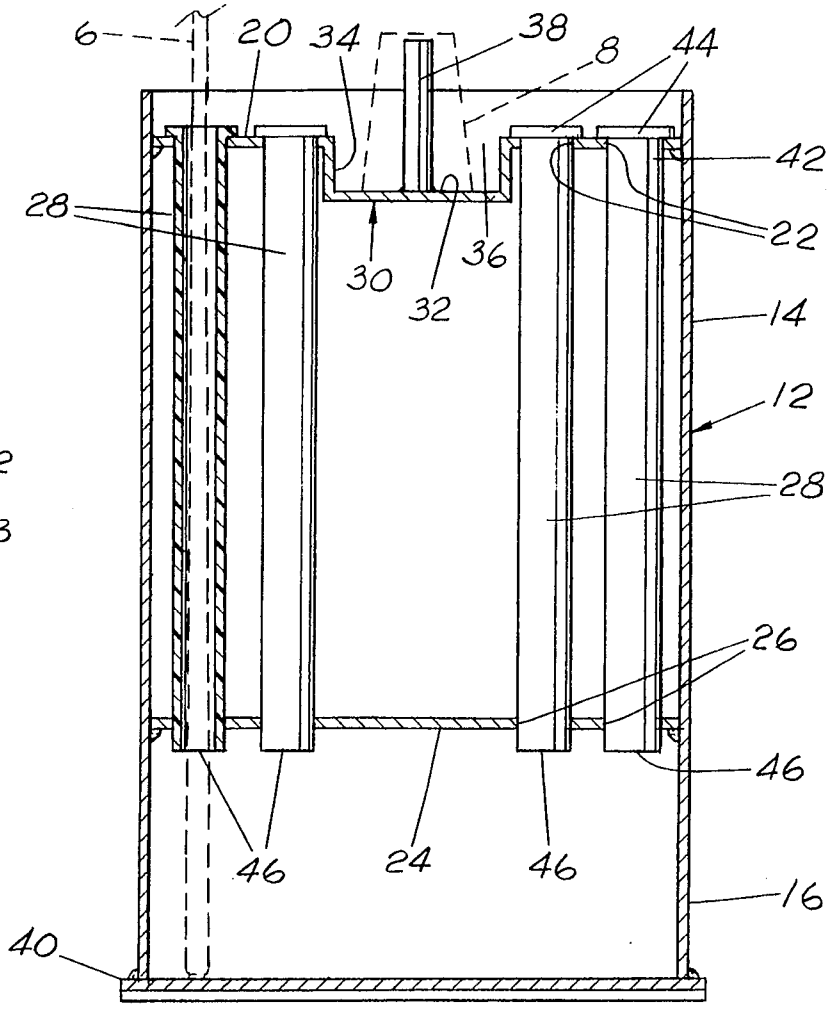
FIG. 2 is a view taken along line 2—2 of FIG. 1.
Figure 1:
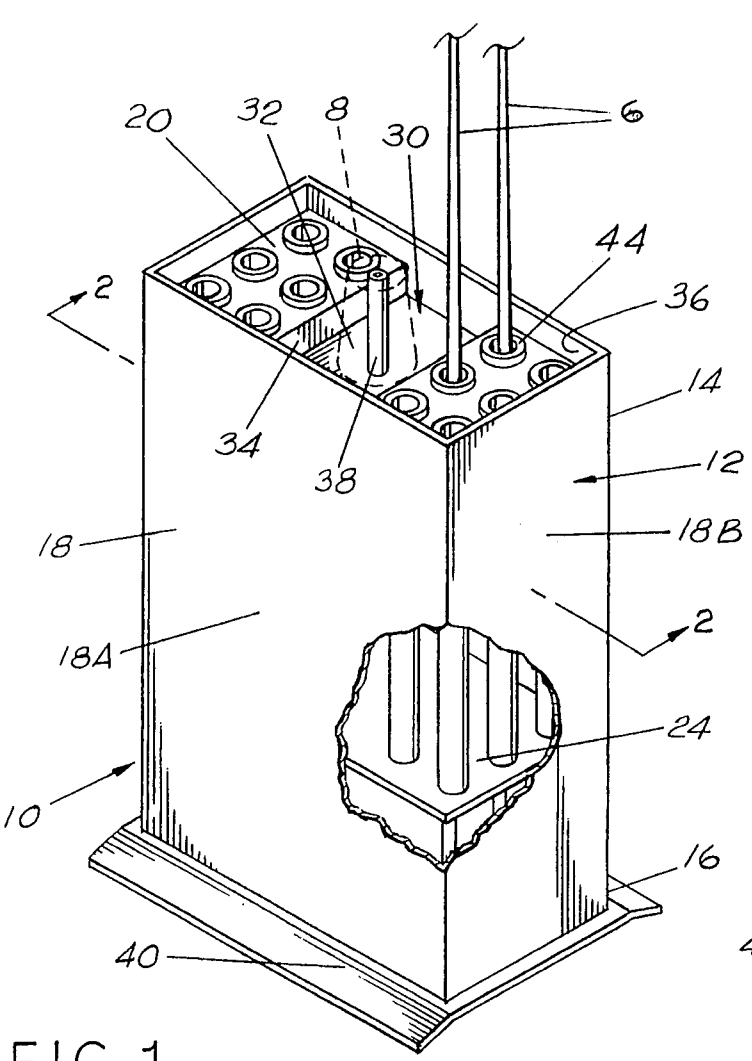
FIG. 1 is a top, front perspective view of a first embodiment of the cue stand and chalk holder according to the present invention.

Referring to FIGS. 1 and 2, a first embodiment of the floor standing pool cue stand for storing cues and cone chalk, designated generally as 10, is shown supporting two pool cues 6 and a cone of chalk 8 shown in dashed lines.

The cue stand 10 includes a housing 12 having an upper end 14 and a lower end 16. The housing 12 includes a substantially vertical surface 18 between the upper and lower ends 14 and 16, respectively. The vertical surface 18 has a surface area suitable for receiving an advertisement easily discernible from an appropriate distance, as for example 10–20 feet, in a room containing billiard or pool tables. The substantially vertical surface 18 includes front and rear surfaces 18A and side surfaces 18B. In the first embodiment as shown in FIG. 1, the front and rear surfaces 18A are approximately 15" wide by 24" high and the side surfaces 18B are approximately 8" wide by 24" high. It is to be understood that these dimensions are for exemplary purposes only and may vary greatly depending on the number of cues 6 and the storage configuration.

A base member 40 is attached to the lower end 16 of the housing 12. The base member 40 rests on a floor surface and provides resistance to overturning. As shown in FIG. 2, the lower end of the cues 6 rest against the base member 40.

Referring to FIGS. 1 and 2, an upper member 20 is attached to the upper end 14 of the housing 12. The upper member 20 has a plurality of openings 22 extending therethrough for receiving the lower end of the cues 6. An intermediate member 24 is attached to the housing 12 at a location below the upper member 20. The intermediate member 24 has a plurality of openings 26 extending therethrough corresponding to the plurality of openings 22 in the upper member 20. The plurality of openings 26 in the intermediate member 24 are substantially vertically positioned below the plurality of openings 22 in the upper member 20.

Referring to FIG. 2, a guide sleeve 28 is a hollow, tubular member which is open at each of two ends. The guide sleeve 28 preferably has an upper end 42 which includes a flange 44 having a diameter greater than the diameter of the holes 22 in the upper member 20. The outer diameter of the tubular member of the guide sleeve 28 is slightly less than the diameter of the openings 22 and 26 in the upper and intermediate members 20 and 24, respectively. The guide sleeve 28 has a length at least as great as the distance between the upper and intermediate members 20 and 24. The lower end 46 of the guide sleeve 28 is vertically inserted through each upper opening 22 and the corresponding lower opening 26 until the guide sleeve 28 is suspended by the flange 44 abutting the upper member 20 as shown in FIG. 2. The guide sleeves 28 guide the cues 6 to a vertical storage position in the cue stand 10. The cue stand 10 can be utilized without the guide sleeves 28; however, the cues 6 could end up being stored in other than a vertical position if the cue 6 is not vertically lowered through the lower opening 26 corresponding to the upper opening 22 through which the cue 6 has been inserted.

As shown in FIGS. 1 and 2, the upper member 20 includes a recessed section 30. The recessed section 30 is comprised of a substantially flat surface 32 which is bounded on its periphery by a pair of substantially vertical walls 34 of the upper member 20 and a pair of substantially vertical surfaces 36 of the housing 12. A cone chalk rod 38 is vertically attached to the flat surface 32 of the recessed section 30. The cone chalk 8 has a central bore which is vertically lowered around the cone chalk rod 38 until the base of the cone chalk rests on the flat surface 32.

Figure 4:
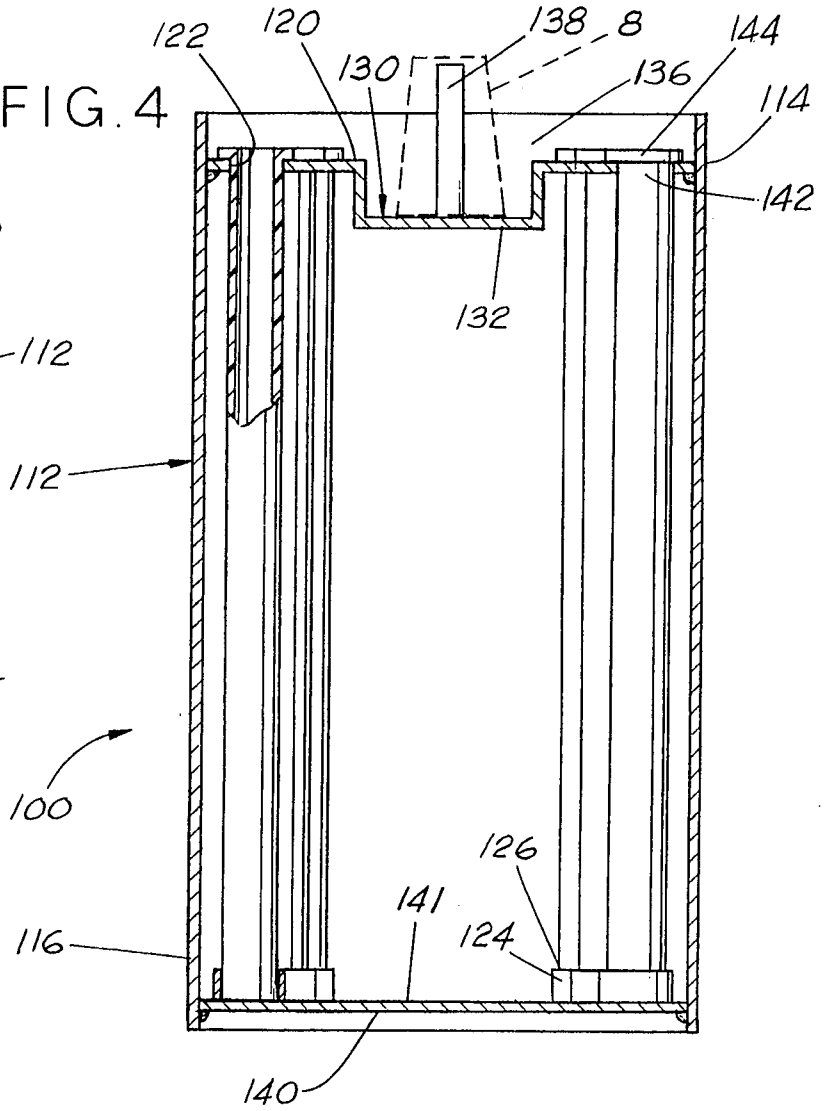
FIG. 4 is a view taken along line 4—4 of FIG. 3.
Figure 3:
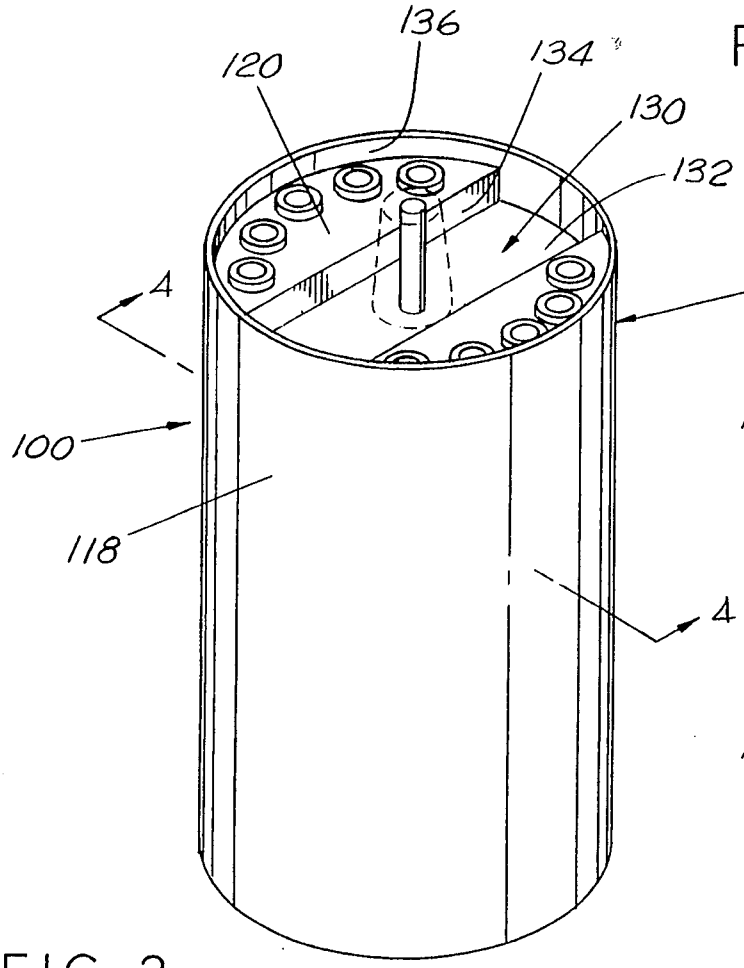
FIG. 3 is a top, front perspective view of a second embodiment of the cue stand and chalk holder.

FIGS. 3 and 4 disclose a second embodiment of the floor standing pool cue stand designated generally as 100. It is to be understood that the second embodiment of the cue stand 100 could be fabricated and assembled just as the first embodiment was described above with the primary difference being in the shape of the housing 112.

The shape of the housing 12 in the first embodiment is intended to give the appearance of a pack of cigarettes so that a cigarette manufacturer could apply its trade dress or advertising material to the vertical surfaces 18A and 18B to give the housing the appearance of a oversized pack of cigarettes. Alternatively, the flat surfaces 18A and 18B of the housing 12 in the first embodiment could have various other types of advertising material attached to the surfaces 18A and 18B. The advertising material could be applied to the surfaces 18A and 18B, as for example, by adhesive or painted on the housing 12.

The shape of the housing 112 in the second embodiment as shown in FIG. 3 is intended to give the appearance of a can, as for example a soft drink or beer can so that a distributor or manufacturer of soft drinks or beer could apply advertising material to the housing surface 118 to promote their products by making the housing 112 look like an enlarged soft drink or beer can.

Referring to FIG. 4, the internal construction of the cue stand 100 and the guide sleeves 28 can be alternatively constructed. In the alternate construction shown in FIG. 4, the lower end 116 of the housing 112 is attached to the base member 140. The base member 140 includes a plurality of sockets 124 attached to an upper surface 141 of the base member 140. The sockets 124 are short tubular members having an open upper end 126.

Referring to FIGS. 3 and 4, an upper member 120 is attached to the upper end 114 of the housing 112. The upper member 120 has a plurality of openings 122 extending therethrough for receiving the lower end of the cues 6. The plurality of openings 122 in the upper member 120 are vertically aligned with the sockets 124.

As described above in the first embodiment, the guide sleeve 128 is a hollow, tubular member which is open at each of two ends. The guide sleeve 128 preferably has an upper end 142 which includes a flange 144 having a diameter greater than the diameter of the holes 122 in the upper member 120. The outer diameter of the tubular member of the guide sleeve 128 is slightly less than the diameter of the openings 122 in the upper member 120 and the openings 126 in the sockets 124. The guide sleeves 128 have a length at least as great as the distance between the upper end of the socket 124 and the upper member 120 such that the lower end of the guide sleeve 128 is received in the socket 124. Alternatively, the guide sleeve 128 could have a length such that bottom of the guide sleeve 128 abuts the upper surface 141 of the base member 140. Although not shown, it may be desirable in this alternate embodiment to omit the upper flange 144 of the guide sleeves 128 since the sleeves 128 are supported by the base member 140.

As shown in FIGS. 3 and 4, the upper member 120 includes a recessed section 130. The recessed section 130 is comprised of a substantially flat surface 132 which is bounded on its periphery by a pair of substantially vertical walls 134 of the upper member 120 and a pair of substantially vertical surfaces 136 of the housing 112. A cone chalk rod 138 is vertically attached to the flat surface 132 of the recessed section 130. The cone chalk 8 has a central bore which is vertically lowered around the cone chalk rod 138 until the base of the cone chalk 8 rests on the flat surface 132.

The cue stand 10, 100 according to the present invention is a floor standing unit which is moveable and extremely durable. Preferably, the cue stand 10, 100 is made of metal with the exception of the guide sleeves 28, 128 which are preferably made of plastic. The cue stand 10, 100 provides large surface areas 18, 118 for displaying advertising materials. The cue stand housing 12, 112 can be various shapes to make the cue stand 10, 100 have the appearance of familiar products such as a cigarette pack, soft drink or beer can. While the invention has been described in connection with having the appearance of a cigarette pack or soft drink/beer can, one skilled in the art will appreciate that the invention is not so limited and that other shapes may be used which would be within the contemplation and scope of the present invention. The storage of the cone chalk 8 in the recessed section 30, 130 eliminates the need and maintenance of a wall mounted cone chalk holder and, even more importantly, eliminates the usual mess and the required clean-up of chalk dust on the floor from the cone chalk 8.

The foregoing disclosure and description of the invention are illustrative and explanatory thereof, and various changes in the size, shape and materials, as well as in the details of the illustrated construction, may be made without departing from the spirit of the invention.

What is claimed is:

1. A storage apparatus for use with pool cues and cone chalk, the pool cues comprising a slender rod having a tip at one end and tapering to a thicker base portion at a second end, the storage apparatus comprising:

a housing having vertical side walls an upper end and a lower end;

a substantially horizontal upper member within said housing intermediate said ends attached to said housing, said upper having a plurality of openings extending therethrough;

a substantially horizontal lower member within said housing, spaced from said upper member and intermediate said ends attached to said housing below said upper member, said lower member having a plurality of openings extending therethrough corresponding to said plurality of openings in said upper member and which are substantially vertically positioned below said plurality of openings in said upper member; and a substantially vertically extending rod attached to said upper member for attaching a cone chalk, said openings in said upper and lower members are sized to receive the base portion of the pool cue therethrough.

2. The storage apparatus of claim 1, wherein said housing has substantially vertical sidewalls having a surface area suitable for receiving an advertisement.

3. The storage apparatus of claim 1, wherein said lower member is positioned approximately midway between said upper and lower ends.

4. The storage apparatus of claim 1, further comprising a base member attached to said lower end of said housing.

5. The storage apparatus of claim 1, further comprising a plurality of cylindrical sleeves, wherein each said sleeve is vertically inserted through one said opening in said upper member and one said opening in said lower member and each said cylindrical sleeve has a bore therethrough sized to receive the base portion of the pool cue therethrough.

6. A storage apparatus for use with pool cues and cone chalk, comprising:

a housing having vertical side walls, an upper end and a lower end;

a substantially horizontal upper member within said housing intermediate said ends attached to said housing, said upper member having a plurality of openings extending therethrough and having a recessed portion;

a substantially horizontal intermediate member attached to said housing below said upper member, said intermediate member having a plurality of openings extending therethrough corresponding to said plurality of openings in said upper member and which are substantially vertically positioned below said plurality of openings in said upper member; and a rod attached to said upper member in said recessed portion for locating the cone chalk, wherein said openings in said upper and intermediate members are sized to receive a pool cue.

7. The storage apparatus of claim 6, wherein said intermediate member is positioned approximately midway between said upper and lower ends.

8. The storage apparatus of claim 6, further comprising a plurality of cylindrical sleeves, wherein each said sleeve is vertically inserted through one said opening in said upper member and one said opening in said intermediate member and each said cylindrical sleeve has a bore therethrough sized to receive the base portion of the pool cue therethrough.

9. The storage apparatus of claim 6, wherein said openings in said upper and intermediate members are sized to receive the base portion of the pool cue.

10. The storage apparatus of claim 6, wherein said housing has substantially vertical side walls having a surface area suitable for receiving an advertisement.

11. A storage apparatus for use with pool cues, comprising:

a housing having vertical side walls, an upper end and a lower end, said side walls providing a surface area for receiving advertisements;

means for individually storing pool cues in a substantially vertical position, wherein said means for individually storing comprises:

a substantially horizontal upper member within said housing intermediate said ends attached to said housing, said upper member having a plurality of openings extending therethrough and having a recessed portion; and a substantially horizontal lower member within said housing, spaced from said upper member and intermediate said ends attached to said housing below said upper member, said lower member having means for receiving a lower end of pool cues; and a rod attached to said upper member in said recessed portion for attaching a cone chalk.

12. The storage apparatus of claim 11, further comprising a plurality of sleeves, each said sleeve having an upper end and a lower end, wherein each said sleeve is vertically inserted through one said opening in said upper member and said lower end of said sleeve is received by said lower member.

13. The storage apparatus of claim 11, wherein said recessed portion provides storage for billiard chalk.

* * * * *